US007346957B2

(12) United States Patent
Nakamoto et al.

(10) Patent No.: US 7,346,957 B2
(45) Date of Patent: Mar. 25, 2008

(54) VACUUM CLEANER

(75) Inventors: Hiroshi Nakamoto, Omihachiman (JP); Norihiro Tsuchiya, Omihachiman (JP); Tamaki Nishikori, Kusatsu (JP); Yasuhiro Madokoro, Yokaichi (JP); Yasuhiro Yuasa, Yokaichi (JP); Kazuhisa Morishita, Yokaichi (JP)

(73) Assignee: Matsushita Electric Industrial, Osaka (JP)

( * ) Notice: Subject to any disclaimer, the term of this patent is extended or adjusted under 35 U.S.C. 154(b) by 679 days.

(21) Appl. No.: 10/721,878

(22) Filed: Nov. 26, 2003

(65) Prior Publication Data

US 2004/0226129 A1 Nov. 18, 2004

(30) Foreign Application Priority Data

Nov. 28, 2002 (JP) ..... 2002-345499
Nov. 28, 2002 (JP) ..... 2002-345519
Nov. 28, 2002 (JP) ..... 2002-345521

(51) Int. Cl.
*A47L 9/20* (2006.01)

(52) U.S. Cl. ..... 15/352; 15/339; 55/304

(58) Field of Classification Search ..... 15/327.1, 15/327.2, 327.3, 327.4, 327.5, 327.6, 327.7; 55/304, 305
See application file for complete search history.

(56) References Cited

U.S. PATENT DOCUMENTS

| | | | | |
|---|---|---|---|---|
| 3,591,888 | A * | 7/1971 | Takeda et al. | 15/323 |
| 3,708,962 | A | 1/1973 | Deguchi et al. | |
| 3,731,465 | A | 5/1973 | Ohira et al. | |
| 3,841,067 | A * | 10/1974 | Kato et al. | 55/300 |
| 3,938,971 | A * | 2/1976 | McClure | 55/300 |
| 4,199,334 | A * | 4/1980 | Berkhoel | 55/304 |
| 5,035,024 | A * | 7/1991 | Steiner et al. | 15/339 |
| 5,216,778 | A | 6/1993 | Suzuki et al. | |

FOREIGN PATENT DOCUMENTS

| | | | |
|---|---|---|---|
| EP | 0024636 | | 3/1981 |
| EP | 1010387 | A2 * | 6/2000 |
| EP | 1 410 750 | * | 4/2004 |
| JP | 05-091962 | | 4/1993 |
| JP | 5-192278 | * | 8/1993 |
| JP | 05192278 | | 8/1993 |

* cited by examiner

*Primary Examiner*—David A Redding
(74) *Attorney, Agent, or Firm*—Bacon & Thomas, PLLC

(57) ABSTRACT

A vacuum cleaner includes an electric blower for generating a suction air stream and a dust collecting unit for collecting dirt particles contained in the suction air stream. The suction air stream passing through the dust collecting unit into the electric blower flows in an approximately linear path. A dust removing unit is provided for removing dirt particles adhered to the dust collecting unit. The dust removing unit is preferably disposed adjacent to a communication hole between the dust collecting chamber and an electric blower chamber.

14 Claims, 12 Drawing Sheets

VACUUM CLEANER

FIELD OF THE INVENTION

The present invention relates to a vacuum cleaner capable of preventing deterioration of suction force even though dirt particles are accumulated in its dust collecting unit.

DESCRIPTION OF THE PRIOR ART

A conventional vacuum cleaner will now be described with reference to FIG. 15.

Reference numeral 9 represents an electric blower for generating a suction air stream, and reference numeral 12 is a dust bag for collecting dirt particles. Electric blower 9 and dust bag 12 are disposed in separate chambers, respectively, and dust removing unit 13 is provided for removing dirt particles adhered to surface 12*a* of dust bag 12 facing communication hole 6 formed in partition 7 installed at main body 1. Dust removing unit 13 is provided with vibrating plate 15 which is vibrated by control unit 17 to knock dirt particles off surface 12*a* of dust bag 12 so that dirt particles adhered to surface 12*a* are removed therefrom, thereby preventing deterioration of suction force (see, e.g., Japanese Patent Laid-Open Publication No. 1993-91962).

However, in such a conventional vacuum cleaner, while dirt particles are likely to adhere to surface 12*b* of dust bag 12 opposite to suction port 1*a* through which a suction air stream is introduced into dust bag 12, dust removing unit 13 is intended to act on surface 12*a* of dust bag 12. As a result, the removal of dust is not performed efficiently and reliably.

SUMMARY OF THE INVENTION

It is, therefore, an object of the present invention to provide a vacuum cleaner capable of efficiently removing dirt particles adhered to surfaces of a dust collecting unit, preventing deterioration of suction force, and enhancing the dust collecting performance thereof.

In accordance with an aspect of the present invention, there is provided a vacuum cleaner comprising: an electric blower for generating a suction air stream; a dust collecting unit for collecting dirt particles contained in the suction air stream, wherein the suction air stream passing through the dust collecting unit into the electric blower flows in an approximately linear path; and a dust removing unit for removing dirt particles adhered to the dust collecting unit.

In accordance with another aspect of the present invention, there is provided a vacuum cleaner comprising: an electric blower for generating a suction air stream; a dust collecting unit having a hard anchor part and a dust collecting part for collecting dirt particles contained in the suction air stream; a dust collecting chamber containing the dust collecting unit, wherein the dust collecting unit is held in the dust collecting chamber by the hard anchor part; and a dust removing unit for removing dirt particles adhered to the dust collecting unit.

In accordance with a further aspect of the present invention, there is provided a vacuum cleaner comprising: a main body incorporating therein an electric blower for generating a suction air stream; a dust collecting unit for collecting dirt particles contained in the suction air stream; and a dust removing unit for removing dirt particles adhered to the dust collecting unit, wherein at least one portion of the main body is transparent or translucent so that a user can see an operation of the dust removing unit.

In accordance with still another aspect of the present invention, there is provided a vacuum cleaner comprising: a main body incorporating therein an electric blower for generating a suction air stream; a dust collecting unit for collecting dirt particles contained in the suction air stream; a dust removing unit for removing dirt particles adhered to the dust collecting unit; and an indication unit including a light display unit indicating an operation state of the dust removing unit, wherein at least one portion of the main body is transparent or translucent so that a user can see the indication unit.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENTS

A first preferred embodiment of the present invention will now be described with reference to FIGS. 1 to 5.

Figure 1:
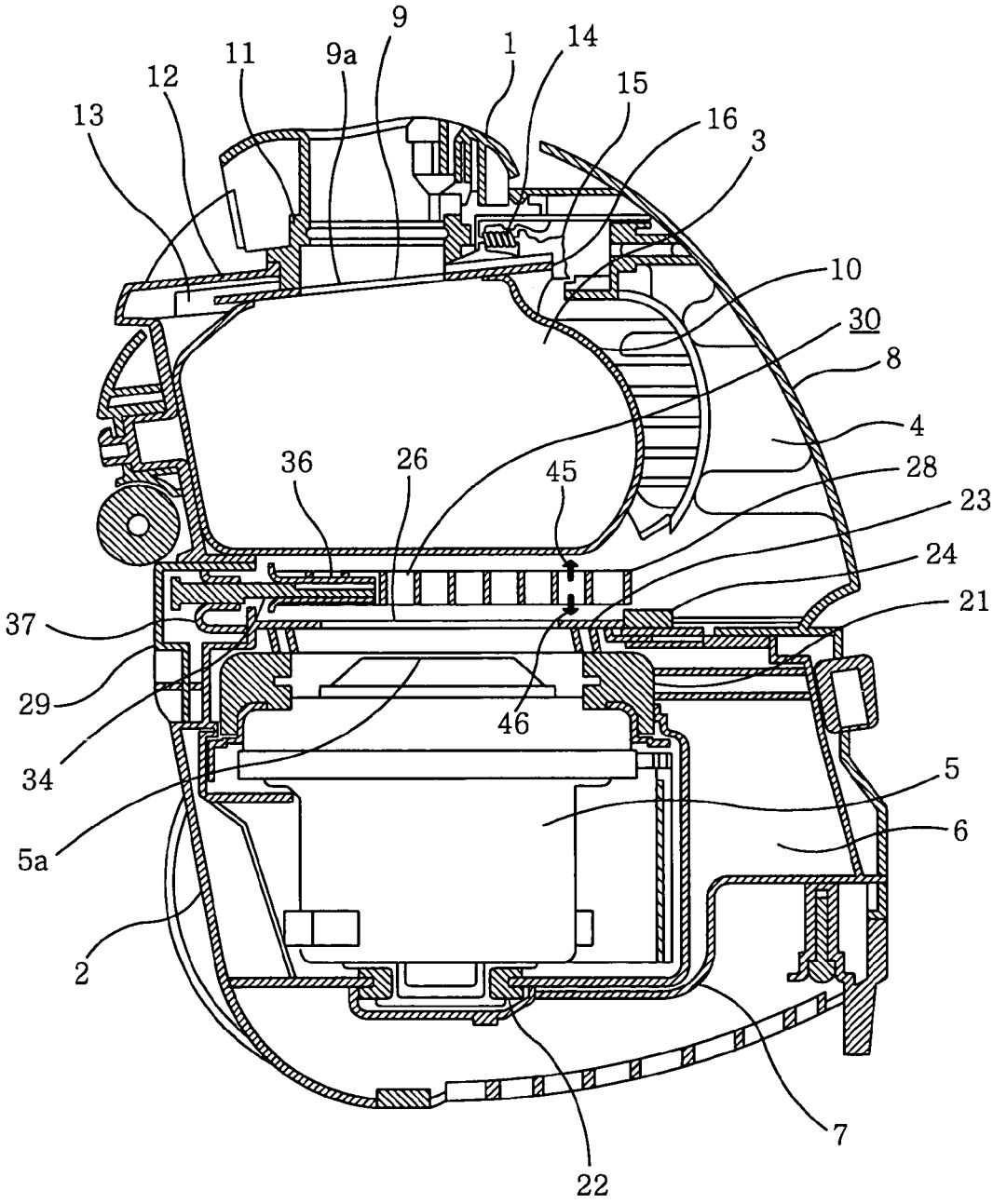
FIG. 1 represents a cross sectional side view of a vacuum cleaner in accordance with a first preferred embodiment of the present invention.
Figure 2:
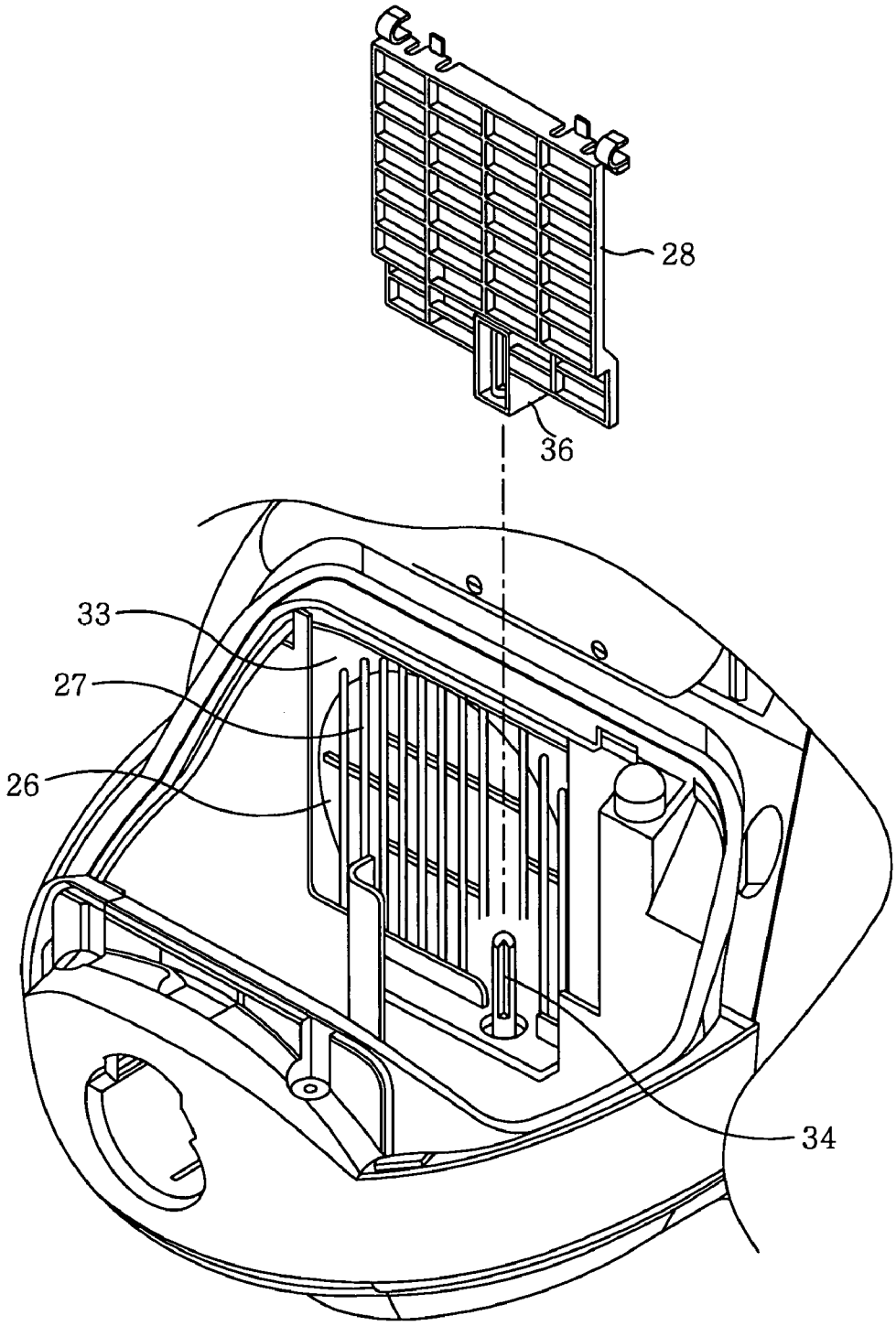
FIG. 2 illustrates a perspective view of the vacuum cleaner with a cover removed.

As shown in FIGS. 1 and 2, main body 1 includes dust collecting chamber 4 containing dust collecting unit 3 for collecting dirt particles, which is located at a front side of lower case 2 with its top opened, and electric blower chamber 6 containing electric blower 5 for generating a suction air stream, which is located at a rear side of lower case 2. Upper case 7 covers top of electric blower chamber 6, and hood 8 is openably pivoted at upper case 7 above dust collecting chamber 4.

Dust collecting unit 3 includes anchor part 9 made of a hard material and dust collecting part 10 comprised of a dust bag which is made of a soft material and has air permeability. Front wall 12 holding non-return valve 11 is provided at the front side of dust collecting chamber 4, and retaining rib 13 having an approximate L-shape in section is extended in a C-configuration under dust collecting chamber 4. Further, installed at an upper side of dust collecting chamber 4 is anchor part holder 15 which is pivotably hinged and urged by spring 14. They serve as a retaining mechanism for holding dust collecting unit 3 in dust collecting chamber 4.

A bottom edge of anchor part 9 of dust collecting unit 3 is fitted into retaining rib 13, and anchor part holder 15 is then pivoted onto a top edge of anchor part 9 such that claw 16 is engaged therewith, thereby retaining dust collecting unit 3 in place. At this time, anchor part 9 is retained close to non-return valve 11 so that dust collecting unit 3 is held in dust collecting chamber 4 in a tight manner, thereby preventing leakage of dust.

Electric blower 5 is sandwiched between lower case 2 and upper case 7 via front cushion 21 and rear cushion 22. Partition 23 for separating dust collecting chamber 4 and electric blower chamber 6 is extended between lower case 2 and hood 8. Packing 24 is provided around partition 23 to ensure air tightness. Electric blower chamber 6 communicates with dust collecting chamber 4 through communication hole 26 formed in partition 23. Communication hole 26 is aligned with suction port 5*a* of electric blower 5, and grid-shaped rib 27 is provided to communication hole 26.

In dust collecting chamber 4 located upstream of communication hole 26, dust removing unit or vibrator 30 having vibrating plate 28 is installed facing an outer surface of dust collecting part 10 of dust collecting unit 3. Vibrating plate 10 vibrates to strike the outer surface of dust collecting part 10.

Dust removing unit or vibrator 30 is received in a space below lower case 2 under dust collecting chamber 4 and held by bottom cap 29. Vibrator 30 includes body case 32, movable plate 33, hollow cylindrical arm 34 extended from movable plate 33 and protruded into dust collecting chamber 4, and grid-shaped vibrating plate 28 having connection portion 36 coupled with arm 34. Since vibrating plate 28 is positioned adjacent to the outer surface of dust collecting part 10 facing communication hole 26 of partition 23, vibrating plate 28 is formed with a grid shape with a plurality of openings so as not to block the suction air stream passing through dust collecting part 10 into communication hole 26.

Figure 3:
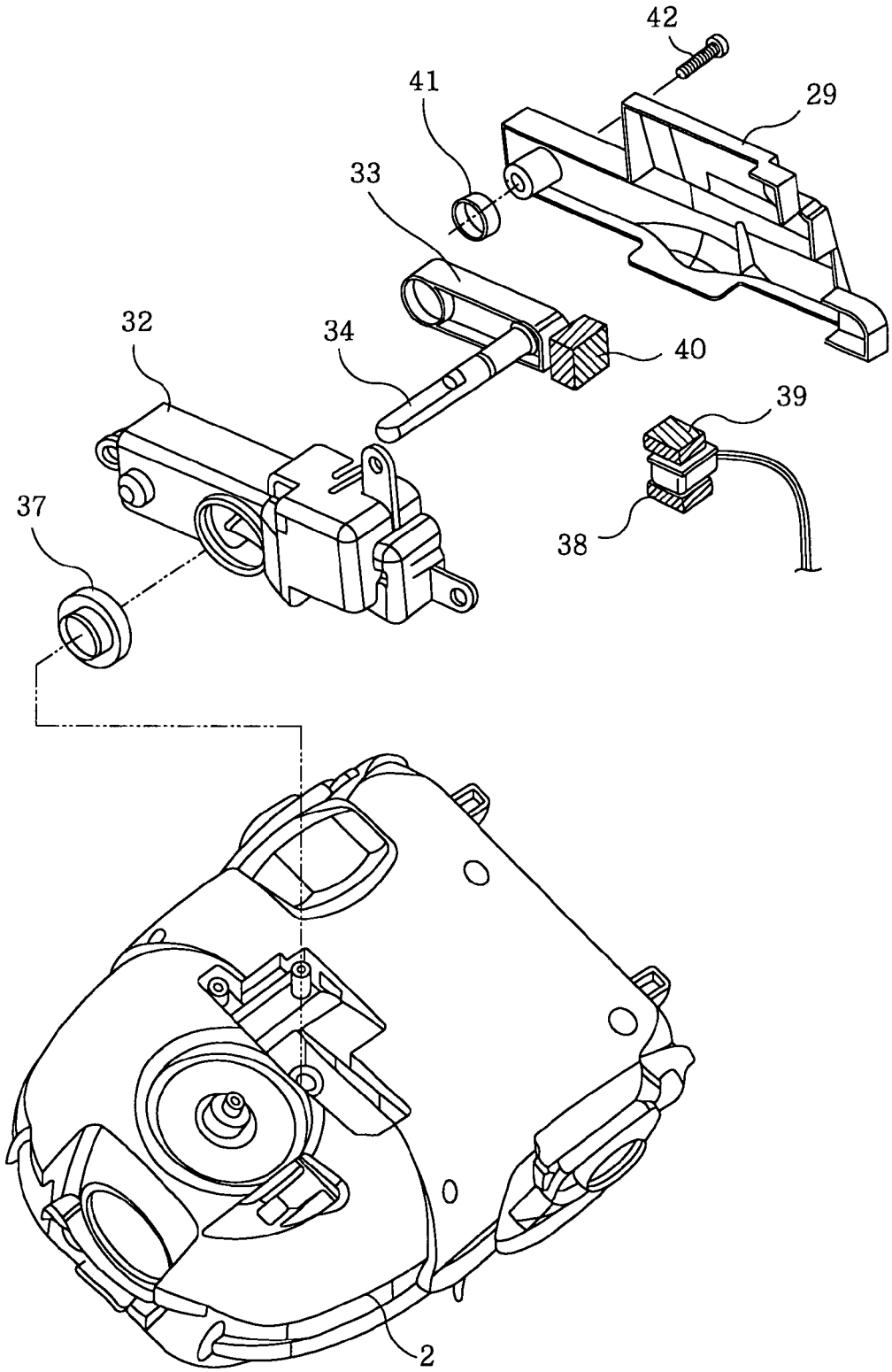
FIG. 3 shows an exploded perspective view of a lower case and a dust removing unit of a main body of the vacuum cleaner.
Figure 4:
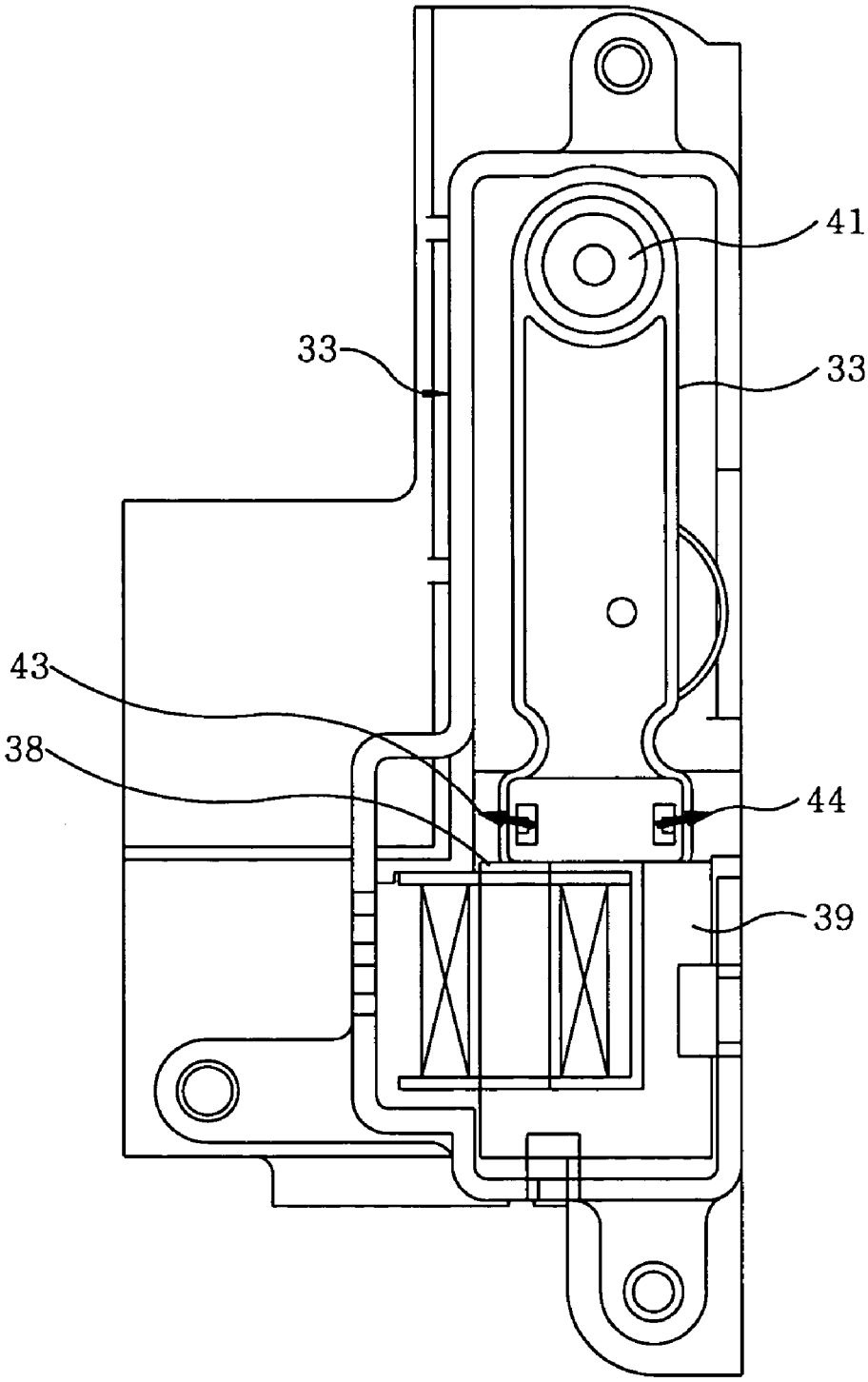
FIG. 4 provides an enlarged view of a vibrator of the dust removing unit.
Figure 5:
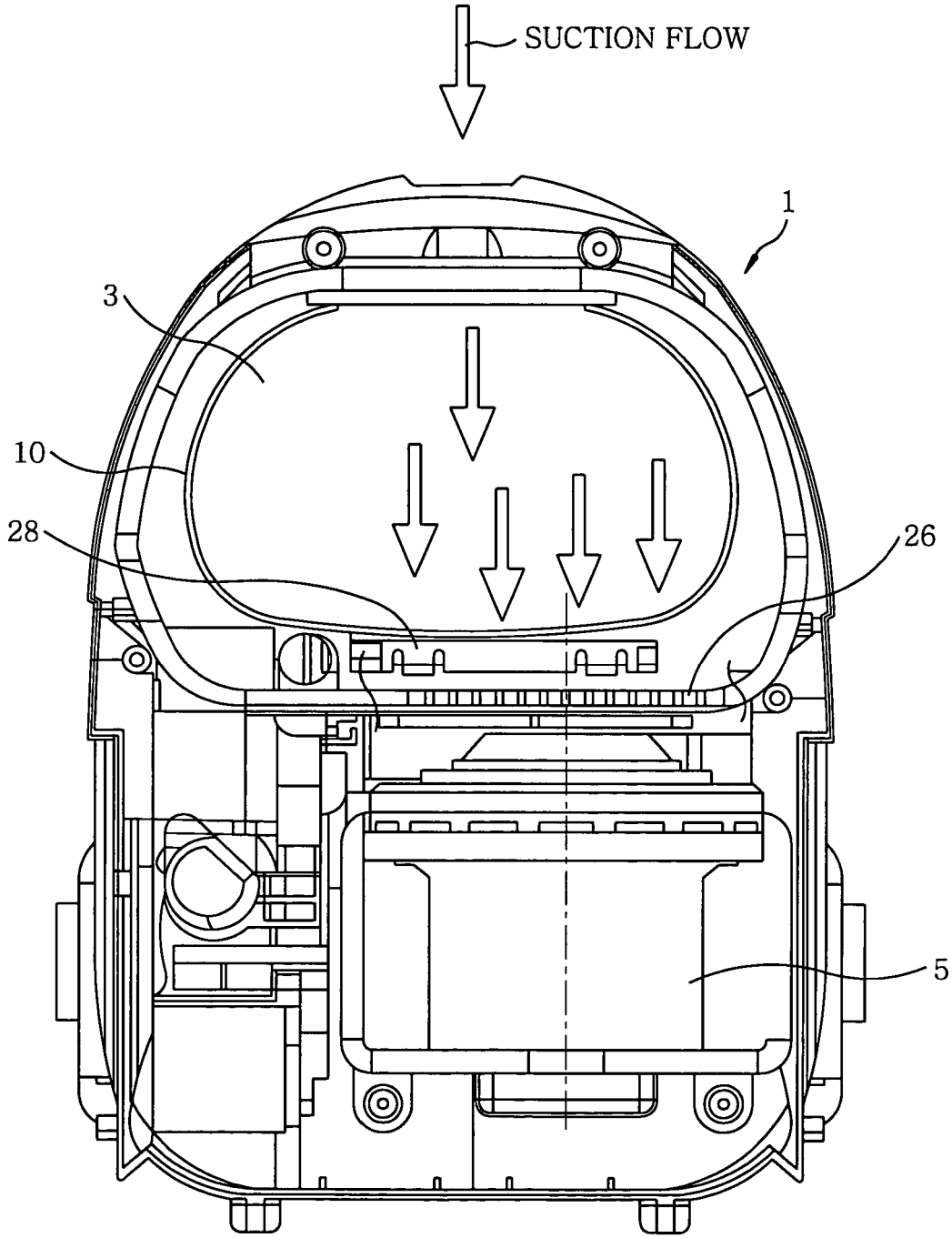
FIG. 5 depicts a top view of the main body with an upper case removed.

Further, as shown in FIGS. 3 and 4, arm 34 is secured to body case 32 via ring-shaped bushing 37 made of, e.g., rubber. Installed in body case 32 are electromagnet legs 38, 39 and movable plate 33 having permanent magnet 40 at one end thereof facing operational surfaces of electromagnet legs 38, 39, permanent magnet 40 being disposed parallel therewith. The other end of movable plate 33 is pivotably fixed to body case 32 by means of screw 42 through sleeve 41 made of, e.g., rubber.

When a vibrator driving switch (not shown) is turned "on" by a vibration control circuit (not shown), AC voltage, e.g., AC 100V, is supplied to coils wound on electromagnet leg 38 to generate magnetic fields around electromagnet legs 38, 39. Due to the magnetic fields generated around electromagnet legs 38, 39, movable plate 33 is pivoted about its fixed end, which in turn moves or vibrates at a frequency of the AC power (50 Hz or 60 Hz) arm 34 supported by rubber bushing 37 in the directions indicated by arrows 43, 44. Subsequently, since the vibration of arm 34 is transferred to vibrating plate 28, vibrating plate 28 moves in the directions indicated by arrows 45, 46 (FIG. 1) as well, thereby vibrating the outer surface of dust collecting part 10 of dust collecting unit 3 to remove the dust adhered thereto.

As described above, in this embodiment, by installing dust removing unit 30 for removing dirt particles adhered to dust collecting part 10, dirt particles attached and deposited on dust collecting part 10 of dust collecting unit 3 can be dropped, thereby preventing deterioration of suction force and hence suction efficiency.

Further, by aligning inlet port 9*a* of dust collecting unit 3 through which a suction air stream is introduced, communication hole 26 and suction port 5*a* of electric blower 5 in an approximately straight line and providing dust removing unit 30 for removing dirt particles adhered to dust collecting part 10 of dust collecting unit 3, the suction air stream linearly flows to decrease an effect of turbulence. As a result, more dirt particles are attached and accumulated in a region of dust collecting part 10 of dust collecting unit 3 and dust removing unit 30 strikes the region, thereby increasing dust removal efficiency.

In addition, dust removing unit 30 exerts vibrations on dust collecting part 10 of dust collecting unit 3 installed in dust collecting chamber 4, mainly on a portion on which dirt particles are attached and accumulated, thereby increasing dust removal efficiency.

Moreover, by installing dust removing unit 30 in dust collecting chamber 4, linkage of a plurality of elements is not required to operate dust collecting chamber 4 and the dust removing operation can be exerted directly on dust collecting unit 3. Therefore, the number of components of dust removing unit 30 is decreased so that the dust removing unit can be constructed in various manners due to the structural simplicity thereof.

Further, since dust removing unit 30 has a plurality air permeable openings of a grid shape, a resistance against a suction air stream is decreased, thereby preventing deterioration of suction performance of the vacuum cleaner.

In addition, vibrating plate 28 of dust removing unit 30 intended to vibrate dust collecting part 10 is a separate member detachably attached to movable plate 33, thereby facilitating the connection of dust removing unit 30 to main body 1. At the same time, in a process wherein vibrating plate 28 for exerting vibrations on dust collecting part 10 is introduced into dust collecting chamber 4 from outside of main body 1, arm 34 provided to movable plate 33 can be formed with a simple, e.g., cylindrical, configuration so that, when arm 34 penetrates into dust collecting chamber 4, a sealing member such as an O-ring can be interposed therebetween easily and reliably, thereby preventing a dust leakage and a decrease in air-tightness.

In addition, since dust collecting part 10 of dust collecting unit 3 installed in dust collecting chamber 4 is made of a soft material, operation of dust removing unit 30 influences only soft dust collecting part 10, not anchor part 9 made of a hard material. As a result, a close-contact state between non-return valve 11 and anchor part 9 of dust collecting unit 3 can be maintained. That is, tightness between non-return valve 11 and anchor part 9 is enhanced, thereby preventing dust leakage therebeween.

Furthermore, when expanded by a suction air stream, dust collecting part 10 becomes a polyhedral configuration and vibrating plate 28 of dust removing unit 3 removes dirt particles adhered to at least one surface of dust collecting part 10. Therefore, areas to which operation of dust removing unit 30 is applied are increased, thereby enhancing dust removal efficiency.

Further, communication hole 26 is provided for allowing electric blower chamber 6 to communicate with dust collecting chamber 4 and dust removing unit 30 is disposed adjacent to communication hole 26, thereby allowing dust removing unit 30 to strike an area of dust collecting part 10 to which more dirt particles are attached. As a result, the efficiency of dust removal is increased.

Since dust removing unit 30 is disposed facing communication hole 26, dust removing unit 30 can act on an area to which most dirt particles are attached, thereby further increasing dust removal efficiency thereof.

As shown in FIG. 1, since rubber bushing 37 which is a part of dust removing unit 30 is disposed in a space formed around an outer periphery of partition 23 separating dust collecting chamber 4 from electric blower chamber 6, it is possible to effectively use a dead space under partition 23 which is a rib wall that does not constitute structural members, thereby resulting in a compact vacuum cleaner.

Further, when dust collecting part 10 is expanded by a suction air stream, dust removing unit 30 may act on 10% or more of the total surface area of dust collecting part 10 in order to further increase dust removal efficiency.

A vacuum cleaner in accordance with a second preferred embodiment of the invention will now be described with reference to FIGS. 6 to 12.

Figure 6:
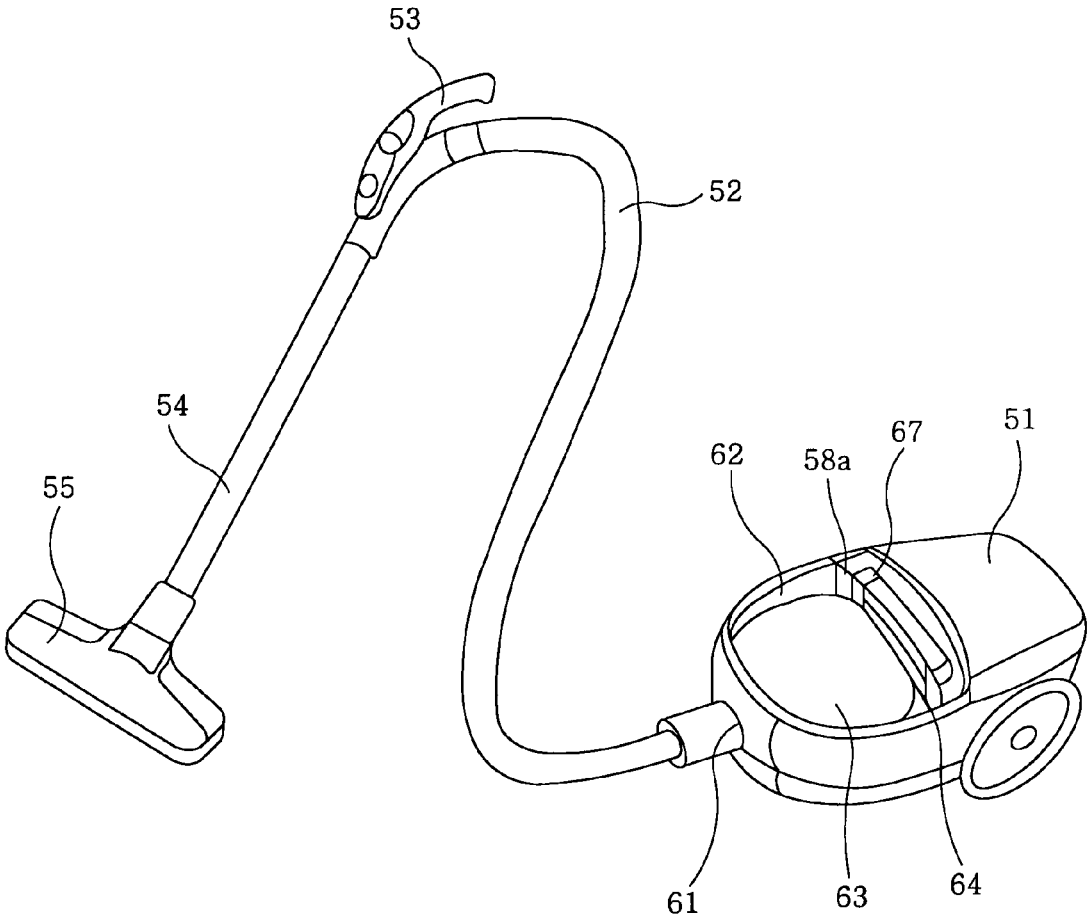
FIG. 6 presents a schematic cross sectional of a vacuum cleaner in accordance with a second preferred embodiment of the invention.
Figure 7:
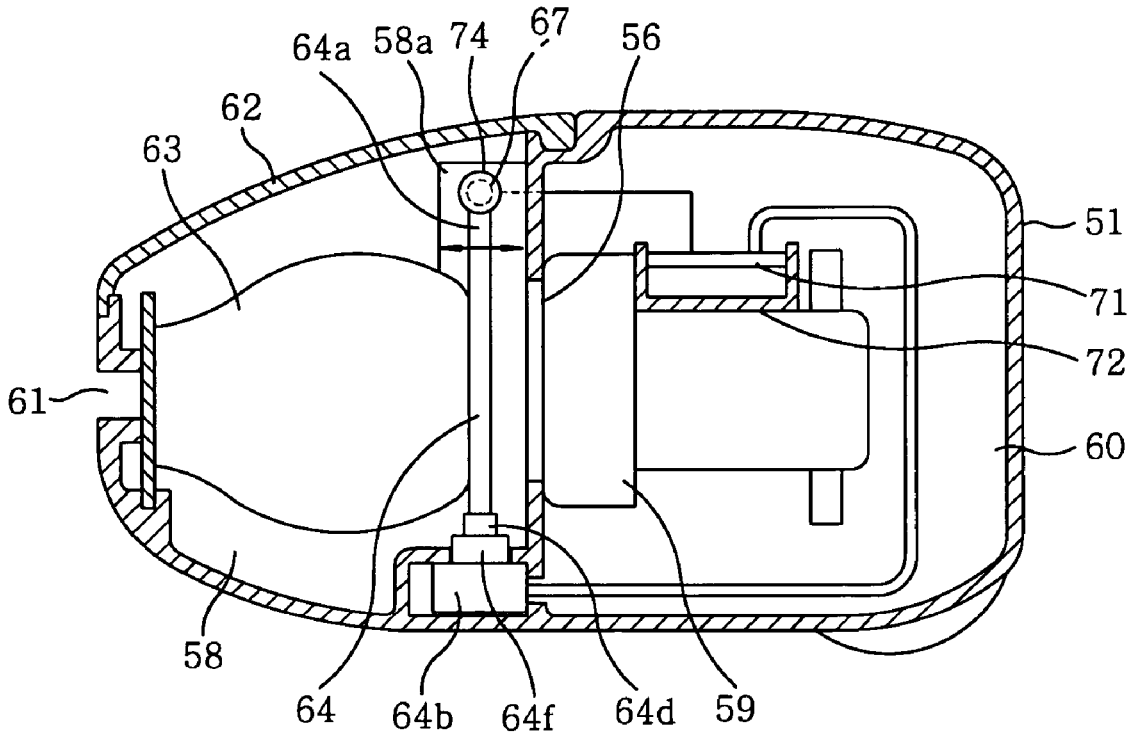
FIG. 7 offers a cross sectional side view of a main body of the vacuum cleaner in accordance with the second preferred embodiment.
Figure 8:
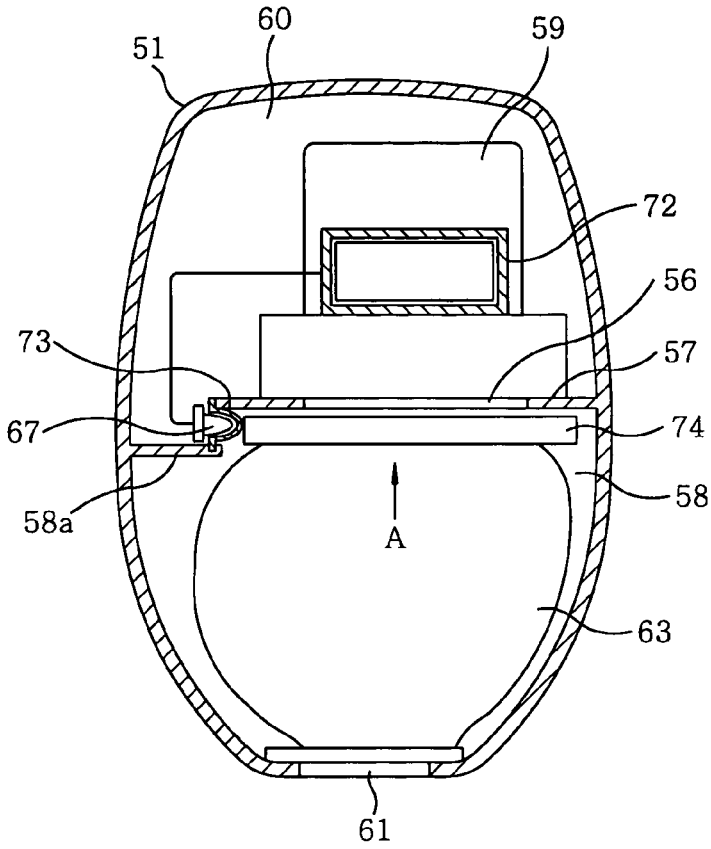
FIG. 8 describes a cross section top view of the main body of the vacuum cleaner in accordance with the second preferred embodiment.

FIG. 6 is a perspective view of the vacuum cleaner of the second embodiment. Reference numeral 51 is a main body and 52 is a hose. Reference numeral 53 represents a grip manipulation unit including a switch for on/off of suction operation of the vacuum cleaner. Reference numeral 54 is an extension pipe, and 55 is a suction tool for suctioning dirt particles on a floor. Main body 51 is connected to suction tool 55 via extension pipe 54 and hose 52 each of which has a suction passageway therein. FIGS. 7 and 8 are cross sectional views partially showing main body 1. Main body 51 is divided into two sections, a front and a rear section, by partition 57 having communication hole 56. Dust collecting chamber 58 is defined in the front section and electric blower chamber 60 containing electric blower 59 for generating a suction air stream is defined in the rear section.

Provided on a front side of dust collecting chamber 58 is suction port 61 to which hose 52 is connected. Suction port 61 communicates with dust bag 63 as a dust collecting part for collecting dirt particles suctioned, dust bag 63 being removably mounted in dust collecting chamber 58 by closing and opening hood 62 which is detachably coupled to main body 1 above dust collecting chamber 58. Hood 62 is formed of a transparent or translucent visible resin so that a user can see inside of dust collecting chamber 58 from outside.

Figure 9:
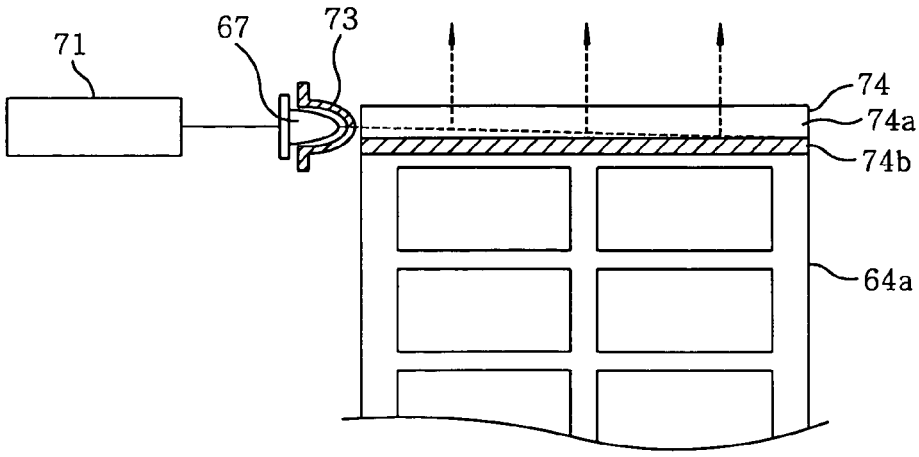
FIG. 9 exhibits a view taken in a direction indicated by arrow A of FIG. 8.
Figure 12:
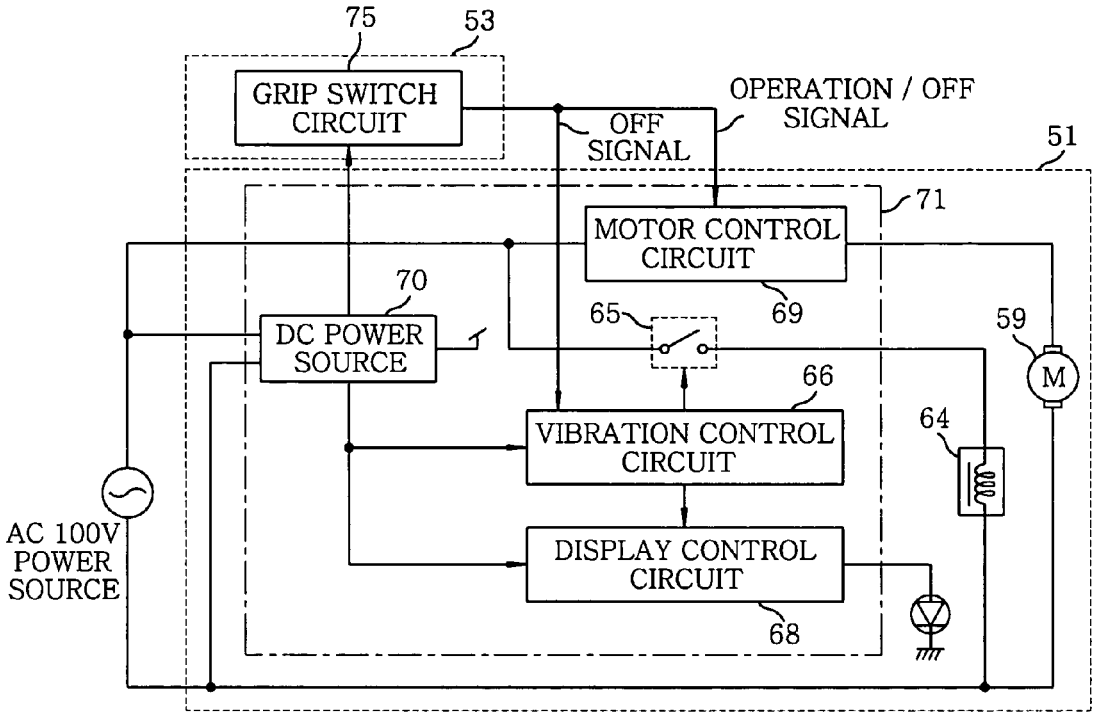
FIG. 12 exemplifies a schematic block diagram showing a control for indicating an operation state of the vibrator.

Reference numeral 64 is a vibrator serving as a dust removing unit uprightly installed in main body 51. Vibrating plate 64a located at a leading end portion of vibrator 64 is disposed adjacent to an outer surface of dust bag 63 facing communication hole 56 of partition 57 (a suction port of electric blower 59). As shown in FIG. 12, control board 71 incorporates therein vibrator driving switch 65 implemented by, e.g., a TRIAC, for providing, e.g., 100 V AC power to vibrator 64; vibration control circuit 66 for ON/OFF controlling vibrator driving switch 65; display control circuit 68 for driving LED 67 serving as an indicator for displaying an operation state of vibrator 64; motor control circuit 69 for controlling the operation of electric blower 59; and DC power source 70 for generating a DC power from the AC power to supply same to vibration control circuit 66 and display control circuit 68. As shown in FIG. 7, control board 71 is installed in board case 72 and disposed above electric blower 59. LED 67 is fixedly mounted in display window 73 which is protruded into dust collecting chamber 58 from stepped side wall 58a thereof, display window 73 being made of a transparent or translucent material. LED 67 is connected to control board 71. As shown in FIG. 9, display window 73 disposed adjacent to one side of diffuser 74 for diffusing and reflecting light from LED 67 upwardly.

Light display unit as an indicator of an operation state of vibrator 64 includes a light emitter comprised of LED 67 and display window 73, and diffuser 74. The light emitter may be disposed on an upper end of vibrating plate 64*a* of vibrator 64.

FIG. 9 is a schematic front view showing an arrangement of LED 67, display window 73 and diffuser 74 with diffuser 74 sectioned. Diffuser 74 is of a cylindrical shape, and has transparent resin portion 74*a* and white diffusing resin portion 74*b* reflecting and diffusing incident light from display window 73 of LED 67 upwardly as indicated by dotted arrows, transparent resin portion 74*a* and white diffusing resin portion 74*b* being integrally formed.

Figure 10:
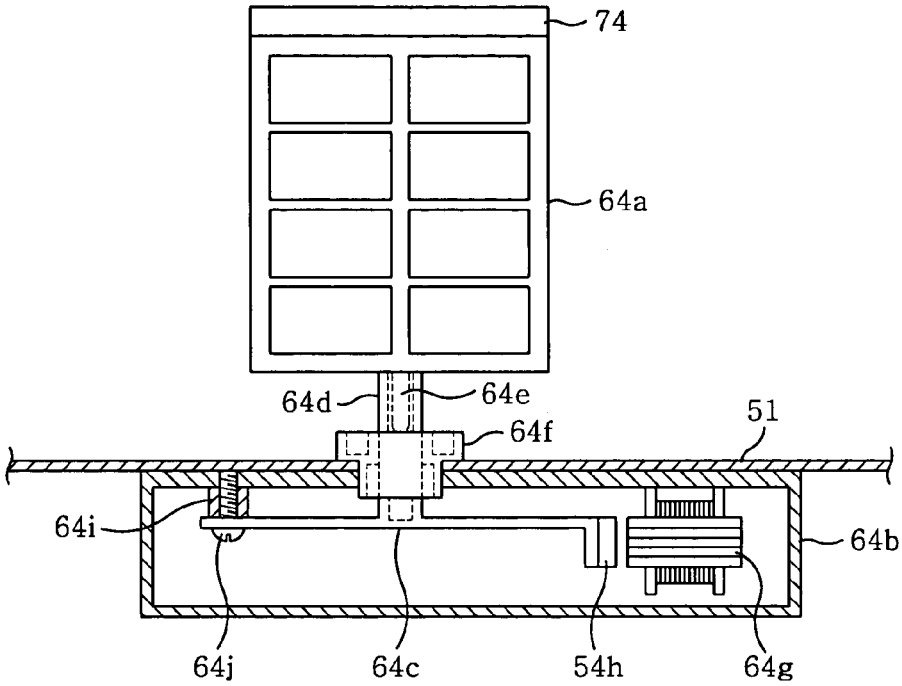
FIG. 10 displays a schematic cross sectional front view of a vibrator of the vacuum cleaner.
Figure 11:
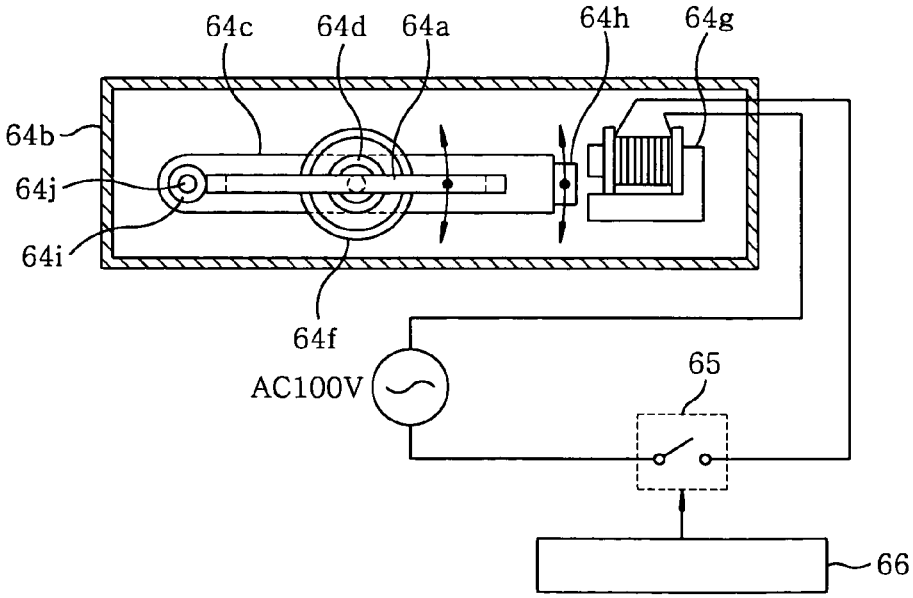
FIG. 11 pictorializes a top view partially showing the vibrator.

Configuration and operation of vibrator 64 will now be described with reference to FIGS. 10 and 11. Vibrator 64 is isolated and fixed to a bottom of main body 51 under dust collecting chamber 58. Protruded into dust collecting chamber 58 is substantially cylindrical arm 64*d* having a hollow portion therein and vertically extending from movable plate 64*c* in body case 64*b* of vibrator 64. Fitted into the hollow portion of arm 64*d* is protrusion 64*e* downwardly extending from a lower portion of vibrating plate 64*a* having a lattice shape. Since vibrating plate 64*a* is disposed adjacent to the outer surface of dust bag 63 facing communication hole 56 of partition 57, vibrating plate 64*a* is formed with the lattice shape so as not to block a suction air stream passing through dust bag 63 into communication hole 56.

Arm 64*d* is fixed to body case 64*b* via bushing 64*f* having a ring shape and made of, e.g., rubber. Installed in body case 64*b* are electromagnet 64*g* and movable plate 64*c* having permanent magnet 64*h* at one end thereof facing an operational surface of electromagnet 64*g*, permanent magnet 64*h* being disposed parallel therewith. The other end of movable plate 64*c* opposite to permanent magnet 64*h* is pivotably fixed to body case 64*b* by means of screw 64*j* through sleeve 64*i* made of, e.g., rubber.

When vibrator driving switch 65 is turned "on" by vibration control circuit 66, AC voltage, e.g., AC 100V is supplied to electromagnet 64*g* to generate a magnetic field therearound. Due to the magnetic field generated around electromagnet 64*g*, movable plate 64*c* is pivoted about its fixed end, which in turn moves or vibrates at a frequency of the AC power (50 Hz or 60 Hz) arm 64*d* supported by rubber bushing 64*f* in the directions indicated by the arrows as shown in FIG. 10. Subsequently, since the vibration of arm 64*d* is transferred to vibrating plate 64*a*, vibrating plate 64*a* vibrates in the same directions as well to strike the outer surface of dust bag 63 repeatedly, thereby performing the dust removing work. Further, diffuser 64 provided on the top of vibrating plate 64*a* also vibrates depending on the vibration of vibrating plate 64*a*.

Figure 13:
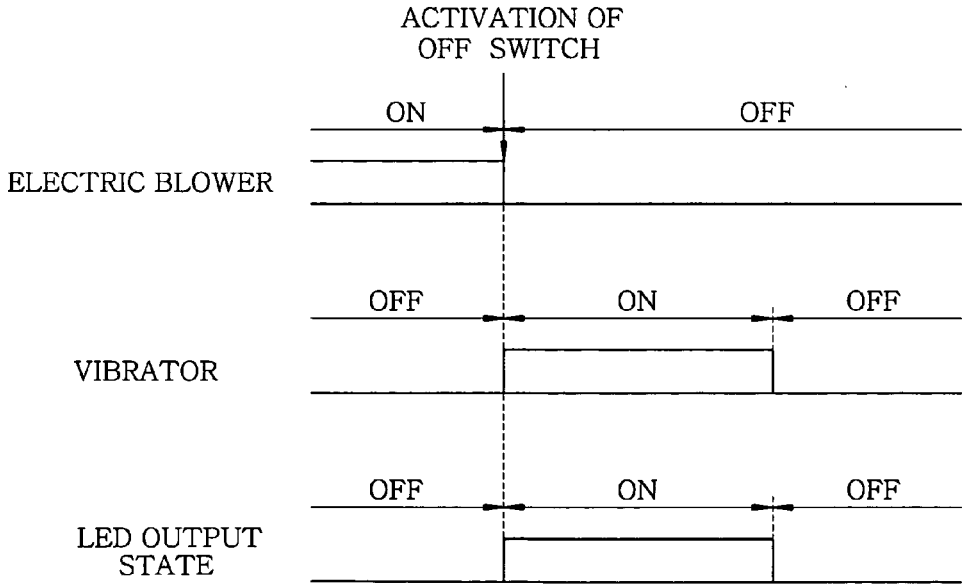
FIG. 13 demonstrates a schematic diagram for explaining an LED display indicating a vibration operation of the vibrator.
Figure 14:
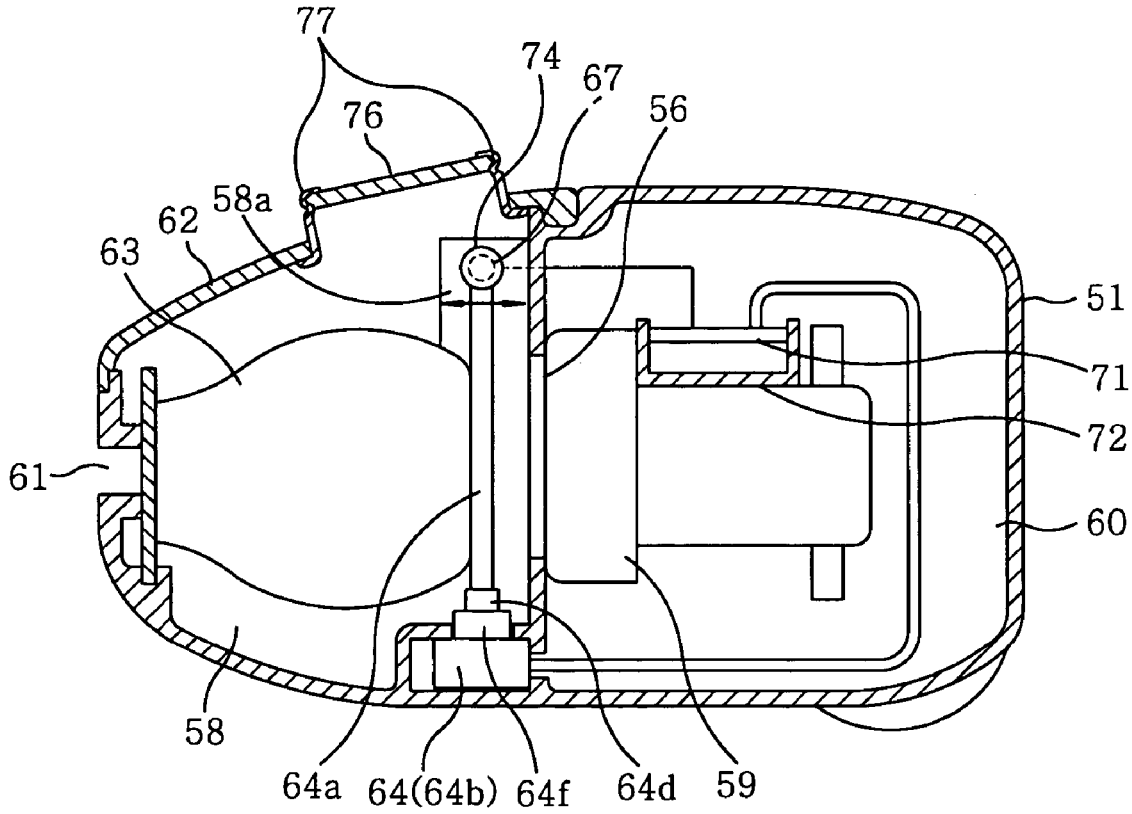
FIG. 14 illustrates a cross sectional side view of a vacuum cleaner in accordance with a third preferred embodiment of the present invention.
Figure 15:
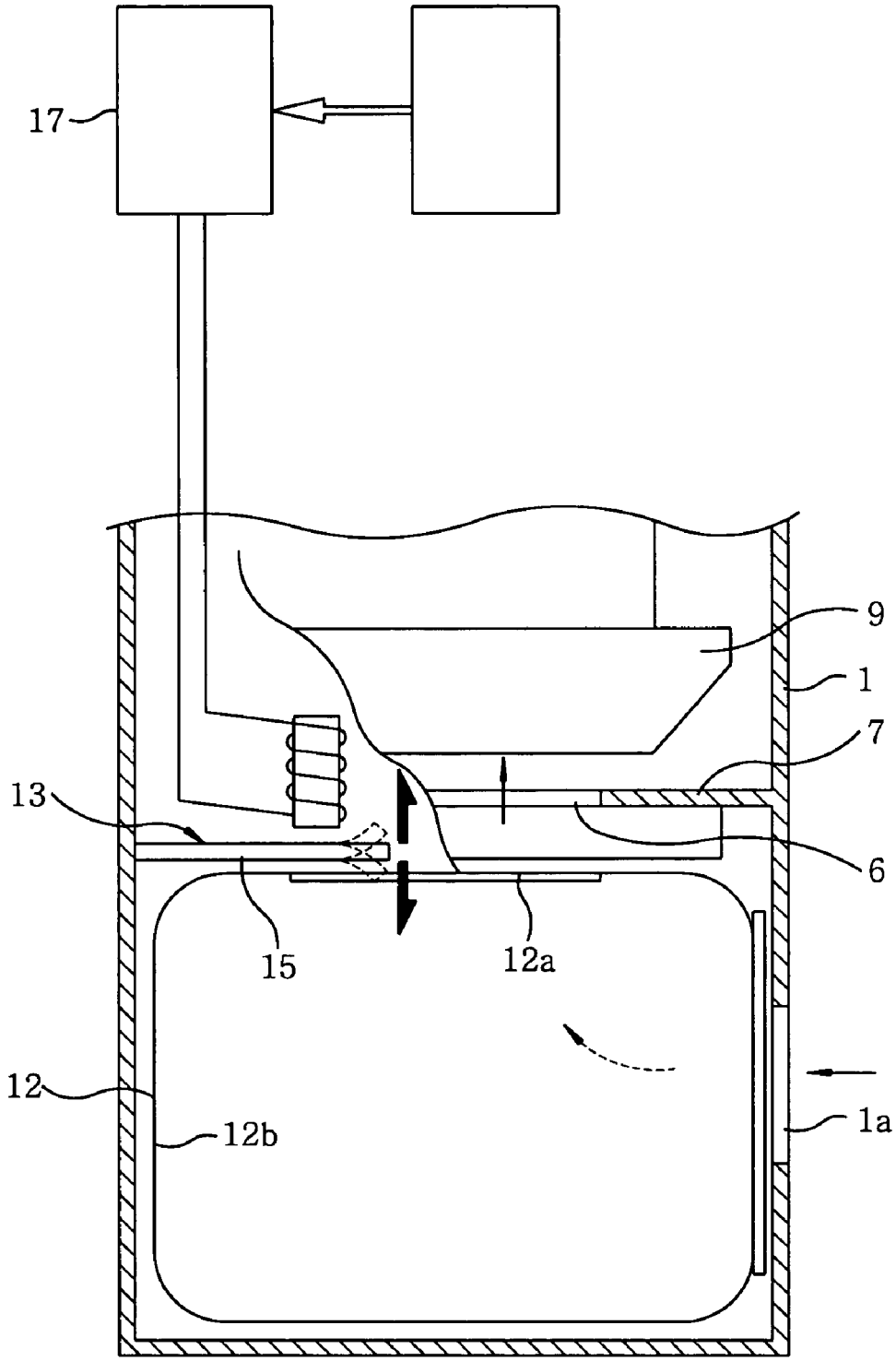
FIG. 15 (PRIOR ART)
FIG. 15 indicates a schematic cross sectional view partially illustrating a conventional vacuum cleaner.

The indication scheme for the vibration dust removing operation in the above configuration will now be described with reference to FIGS. 12 to 13.

When the AC voltage, e.g., AC 100 V, is supplied to main body 1, a DC power is provided from DC power source 70 in control board 71 to vibration control circuit 66; display control circuit 68; and grip switch circuit 75 incorporating therein, e.g., an operation switch (not shown) for starting the operation of electric blower 59 and a power OFF switch (not shown) for halting the operation of electric blower 12. When the operation switch in grip switch circuit 75 is activated to perform cleaning works, a driving signal is provided to motor control circuit 69 in control board 71 so that electric blower 59 is operated and dirt particles are accumulated in dust bag 63.

Next, when the power OFF switch in grip switch circuit 75 is activated to finish the cleansing works, a power off signal from grip switch circuit 75 is inputted to motor control circuit 69 and vibration control circuit 66. In response to the power off signal from grip switch circuit, motor control circuit 69 halts the operation of electric blower 59 and simultaneously vibration control circuit 66 switches vibrator driving switch 65 "on" to operate vibrator 64. Also, vibration control circuit 66 outputs a vibration start signal to display control circuit 68. In response to the vibration start signal, display control circuit 68 turns on LED 67. Light of LED 67 is diffused, and reflected by diffuser 74 to illuminate inside of dust collecting chamber 58 and is radiated to outside of main body 51 through hood 62 as vibrating light in response to the vibration of diffuser 74.

After vibrator 64 is operated for a predetermined time enough to remove dirt articles adhered to an inner surface of dust bag 58, vibrating control circuit 66 switches vibrator driving switch 65 "off" and simultaneously provides a vibration end signal to display control circuit 68. Responding to the vibration end signal, display control circuit 68 turns off LED 67.

Accordingly, a user can appreciate an operational state of vibrator 64 by directly observing the on/off state of LED 67 through hood 62. Even if the user is at a position spaced apart from main body 51 in a dark kitchen, the user can appreciate an operational state vibrator 64 by vibrating light radiated through hood 62. Therefore, the user can easily recognize whether vibrator 64 is properly operated or not, which in turn prevents the user from prematurely disconnecting the power of the vacuum cleaner before the dust removing operation is completed.

Although, in this embodiment, an example wherein hood 62 is made of a transparent or translucent visible resin has been described, the entire case enclosing dust collecting chamber 58 of main body 51 may be made of a transparent or translucent visible resin. That is, it is important that the user can directly see from outside of main body 51 vibrating plate 64*a*, or the light display device having LED 67 and display window 73 or diffuser 74.

In the embodiment described above, although the components such as hood 62 consisting an outer portion of main body 51 is made of a transparent or translucent visible resin, in case window member 76 made of translucent visible resin, through which parts of vibrating plate 64*a* and diffuser 74 can be observed, is mounted to hood 62 (in this case, hood 62 is not necessarily transparent) via vibration transferring member 77 formed of a resilient wave thin diaphragm, the user can appreciate through window member 76 vibrating plate 64*a*, diffuser 74 and vibrating light of LED 67 radiated from diffuser 74.

Further, since the vibration of vibrator 64 vibrates window member 76 via vibration transferring member 77, the user can recognize whether vibrator 64 is operated by checking the movement of window member 76 at a distance from main body 51. In this way, the user can easily recognize whether vibrator 64 is properly operated or not, which in turn prevents the user from prematurely disconnecting the power of the vacuum cleaner before the dust removing operation is completed.

While the invention has been shown and described with respect to the preferred embodiments, it will be understood by those skilled in the art that various changes and modifications may be made without departing from the spirit and scope of the invention as defined in the following claims.

What is claimed is:

1. A vacuum cleaner comprising:

an electric blower for generating a suction air stream;

a dust collecting unit for collecting dirt particles contained in the suction air stream, wherein the suction air stream passing through the dust collecting unit into the electric blower flows in an approximately linear path; and a dust removing unit for removing dirt particles adhered to the dust collecting unit wherein the dust removing unit is disposed on said linear path, and allows the suction air stream to pass therethrough, and wherein the dust removing unit has a member acting on the dust collecting unit, and the member is detachably connected to the dust removing unit.

2. A vacuum cleaner comprising:

an electric blower for generating a suction air stream;

a dust collecting unit having a hard anchor part and a dust collecting part for collecting dirt particles from the suction air stream;

a dust collecting chamber containing the dust collecting unit, wherein the dust collecting unit is held in the dust collecting chamber by the hard anchor part; and a dust removing unit for removing dirt particles adhered to the dust collecting unit, wherein the dust removing unit is disposed on a linear path in which the suction stream passes through the dust collecting unit into the electric blower, and allows the suction air stream to pass therethrough, and wherein the dust removing unit has a member acting on the dust collecting unit, and the member is detachably connected to the dust removing unit.

3. The vacuum cleaner of claim 2, wherein the dust removing unit acts on the dust collecting part.

4. The vacuum cleaner of claim 3, wherein the dust removing unit is installed in the dust collecting chamber.

5. The vacuum cleaner of claim 3, wherein the dust collecting unit is made of a soft material.

6. The vacuum cleaner of claim 3, wherein the dust collecting unit has a polyhedral configuration when expanded by the suction air stream, and the dust removing unit removes dirt particles adhered to at least one surface of the dust collecting unit.

7. The vacuum cleaner of claim 3, further comprising an electric blower chamber containing the electric blower, wherein the electric blower chamber communicates with the dust collecting chamber through a communication hole and the dust removing unit is disposed adjacent to the communication hole.

8. The vacuum cleaner of claim 7, wherein the dust removing unit is disposed facing the communication hole.

9. A vacuum cleaner comprising:

a main body incorporating therein an electric blower for generating a suction air stream; a dust collecting unit for collecting dirt particles contained in the suction air stream; a dust removing unit for removing dirt particles adhered to the dust collecting unit; and an indication unit including a light display unit indicating an operation state of the dust removing unit, wherein at least one portion of the main body is transparent or translucent so that a user can see the indication unit.

10. The vacuum cleaner of claim 9, wherein the light display unit is disposed on a vibrating member of the dust removing unit.

11. The vacuum cleaner of claim 9, wherein the light display unit includes a light emitter and a diffuser diffusing light of the light emitter, the diffuser being disposed on a vibrating member of the dust removing unit.

12. The vacuum cleaner of claim 1, wherein the dust removing unit has a plurality of air permeable openings of a grid shape.

13. The vacuum cleaner of claim 2, wherein the dust removing unit has a plurality of air permeable openings of a grid shape.

14. The vacuum cleaner of claim 9, wherein the dust removing unit has a plurality of air permeable openings of a grid shape.

* * * * *

UNITED STATES PATENT AND TRADEMARK OFFICE

CERTIFICATE OF CORRECTION

PATENT NO. : 7,346,957 B2
APPLICATION NO. : 10/721878
DATED : March 25, 2008
INVENTOR(S) : Hiroshi Nakamoto et al.

It is certified that error appears in the above-identified patent and that said Letters Patent is hereby corrected as shown below:

1. TITLE PAGE, (73) Assignee

"Matsushita Electric Industrial, Osaka (JP)" change to
--Matsushita Electric Industrial Co., Ltd., Osaka (JP)--

Signed and Sealed this

Sixteenth Day of June, 2009

John Doll

JOHN DOLL
*Acting Director of the United States Patent and Trademark Office*